US007648173B2

(12) United States Patent
Silverman

(10) Patent No.: US 7,648,173 B2
(45) **Date of Patent: *Jan. 19, 2010**

(54) STRETCHABLE ELASTOMERIC COATED FABRIC BOOK COVER AND METHOD

(75) Inventor: Robert S. Silverman, Long Beach, CA (US)

(73) Assignee: Kittrich Corporation, La Mirada, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/974,988

(22) Filed: Oct. 28, 2004

(65) Prior Publication Data

US 2006/0091668 A1 May 4, 2006

(51) Int. Cl.
*B42D 3/04* (2006.01)

(52) U.S. Cl. ..... 281/34; 281/29; 281/31; 281/15.1

(58) Field of Classification Search ..... 281/2, 281/3.1, 5, 15.1, 29, 51, 19.1, 34, 31; D19/26, D19/27

See application file for complete search history.

(56) References Cited

U.S. PATENT DOCUMENTS 713,176 A * 11/1902 Thomas et al. ..... 281/34
913,036 A 2/1909 Reynolds
1,479,791 A 1/1924 Degenring
1,540,297 A 6/1925 Walraven
1,595,002 A 8/1926 Davis
2,057,987 A 10/1936 Walraven
2,753,194 A 7/1956 Correa
3,181,695 A * 5/1965 Taterka et al. ..... 206/299
3,222,085 A 12/1965 Young
3,635,392 A * 1/1972 Burgher ..... 206/216
3,905,848 A 9/1975 Williams
4,519,630 A 5/1985 Holmes
4,541,364 A 9/1985 Contello
4,715,619 A 12/1987 Sloot
4,744,592 A 5/1988 Barnette et al.
4,893,979 A 1/1990 Alpers
5,004,514 A 4/1991 Pugliese et al.
5,013,068 A 5/1991 Maldonado
5,017,424 A * 5/1991 Farnworth et al. ..... 442/71
5,029,900 A 7/1991 Axelrod
5,056,663 A 10/1991 Ostrowski (Continued)

FOREIGN PATENT DOCUMENTS

GB 683885 10/1952

(Continued)

*Primary Examiner*—Dana Ross
*Assistant Examiner*—Jamila Williams
(74) *Attorney, Agent, or Firm*—Patentmetrix

(57) ABSTRACT

An adjustable book cover (10) consisting of a unitary hexagonal sheet of stretchable fabric (16) that is preferably coated with an elastomeric polyurethane resin (15). Interstices (19) of the fabric (16) are filled with at least a single layer of polyurethane resin (15), creating an impermeable waterproof barrier while maintaining the elastic functionality of the book cover (10). The hexagonal sheet has flap portions defined by fold lines (44,46,48) that delineate a laterally formed rectangle within the fabric polygon. Extended edges of the upper and lower shaped flap portions are each bisected by a slot (41) of predetermined depth, thus forming an access aperture (21) for the covers of a book when selected flap portions of the hexagon are secured together.

6 Claims, 4 Drawing Sheets

U.S. PATENT DOCUMENTS

| | | | | |
|---|---|---|---|---|
| 5,092,630 | A | 3/1992 | Ostrowski | |
| 5,158,325 | A | 10/1992 | Landis et al. | |
| 5,207,717 | A | 5/1993 | Manning | |
| 5,209,624 | A | 5/1993 | Nicolaisen | |
| 5,219,437 | A | 6/1993 | Moor | |
| 5,470,109 | A * | 11/1995 | Grande | 281/34 |
| 5,535,506 | A | 7/1996 | Chalfin | |
| 5,851,031 | A | 12/1998 | Golson | |
| 5,992,886 | A | 11/1999 | Udd | |
| 6,257,622 | B1 * | 7/2001 | Peker | 281/29 |
| 7,290,801 | B2 | 11/2007 | Silverman | |
| 7,334,819 | B2 | 2/2008 | Silverman | |
| 2003/0027472 | A1 * | 2/2003 | Hyun | 442/76 |
| 2003/0234531 | A1 | 12/2003 | Silverman | |
| 2004/0066031 | A1 | 4/2004 | Wong | |
| 2006/0091668 | A1 | 5/2006 | Silverman | |
| 2007/0085329 | A1 | 4/2007 | Silverman | |

FOREIGN PATENT DOCUMENTS

| | | |
|---|---|---|
| WO | WO2006/110959 | 4/2006 |

* cited by examiner

STRETCHABLE ELASTOMERIC COATED FABRIC BOOK COVER AND METHOD

CROSS REFERENCE TO RELATED APPLICATIONS

Ser. No. 10/177,964, now abandoned.

STATEMENT REGARDING FEDERALLY SPONSORED RESEARCH AND DEVELOPMENT

Not Applicable.

REFERENCE TO MICROFICHE APPENDIX

Not Applicable.

TECHNICAL FIELD

The invention generally pertains to adjustable book covers, and more particularly to a polymerically-coated, elastic fabric cover which conforms to a variety of book sizes. Specifically, the invention features an improved waterproof book cover that is constructed from a stretchable base fabric, wherein the interstices of the fabric are completely filled with at least a single layer of polyurethane resin, and further provides an efficient method for fabricating an adjustable fabric sleeve that snugly envelops the exterior paperboard panels and spine of a book.

BACKGROUND ART

Numerous book covers have been devised to protect schoolbooks and other hard covered texts from moisture or grime. Many of these covers utilize Kraft paper wrappings or have been fabricated from more durable plastic materials. The application of such book covers require the time consuming steps of trimming the cover to size, fashioning and folding flaps, then inserting the front and back panels of a bound book into lateral envelopes formed by the flaps. Adhesive tape may also be required to secure the protective cover into position, which typically will mar a text when removed.

Some conventional book covers have been similarly available with transparent or printed plastic laminates that are coated with a layer of repositionable pressure sensitive adhesive. Although intended to removably adhere to the exposed surfaces of a book, such covers are difficult to remove after long-term usage. Alternatively, stretchable fabric book covers—which have attempted to remedy the problems of paper covers and self-adhesive plastic sleeves—do not provide a uniform waterproof barrier and accordingly fall short of protecting the vulnerable surfaces of a book.

A search of the prior art did not disclose any patents or industry literature that read on the claims of the instant application. However the following U.S. patents are considered related:

| PATENT NO. | INVENTOR | ISSUED |
|---|---|---|
| 5,158,325 | Landis et al | 27 Oct. 1992 |
| 5,470,109 | Grande | 28 Nov. 1995 |
| 6,257,622 | Peker | 10 Jul. 2003 |

U.S. Pat. No. 5,158,325 issued to Landis et al. discloses an adjustable book cover wherein a single piece of elastic sheet-like material is folded in half and sewn along selected peripheral edges. The resulting interior pockets are mutually defined by a sinusoidal stitched seam and are divided by an integral, non-removable, book marker. This arrangement causes the sewn periphery seams of the book cover to come into direct contact with the paperboard edges of an inserted text, thereby resulting in undue wear and cyclical stress along the lines of stitching. In addition, the invention offers no provisions for waterproofing the fabric cover to repel moisture.

U.S. Pat. No. 5,470,109 issued to Grande discloses an adjustable book cover made from an elastic fabric material which is cut in a diamond shaped pattern. Six triangular shaped sections converge inward and are sewn along specified lines to form interior left and right hand pockets for the covers of books of various sizes. The sewn fabric construction provides a seamless adjustable book jacket along the external surfaces of hard covered books. The spine locking feature of this design, however, does not work effectively and the porous weave of the fabric fails to impede dampness.

U.S. Pat. No. 6,257,622 issued to Peker discloses a cloth book cover, preferably of spandex. The cover has lateral pockets to receive the front and back paperboard panels of a book. The peripheral top and bottom edges of the cover are sewn by means of overlock stitching, the protruding portions of which tend to promote local wear on the seam construction. Further, the fabric, although preferably water resistant, is not impermeable to moisture, and requires either a natural or chemical treatment to achieve water resistance.

DISCLOSURE OF THE INVENTION

The stretchable fabric book cover in its basic design includes a book cover access aperture that is laterally bound by a left front cover pocket portion and a right rear cover pocket portion. When the covers of a book are respectively inserted into the left and right portions and the fabric book covers are folded over the book, the book covers are protected from water damage and soiling.

In view of the above disclosure, the primary object of the invention is to provide an adjustable reusable book cover that combines the aesthetic attributes of a stretchable fabric, with the desirable properties of a durable polymeric coating that prevents water damage and soiling.

It is a further object of the present invention to provide a book cover that is fabricated from a polyurethane-coated stretchable fabric. The interstices of the elastic fabric are filled with a polyurethane resin to create an impermeable waterproof barrier while maintaining the elastic functionality of the book cover.

The present invention features a flexible, empanelled book cover having pocket portions that are mutually defined by a centrally located access slot. The access slot runs parallel with the spine of the book and permits the uncomplicated insertion of the paperboard panels of the book.

The book cover consists of a unitary hexagonal sheet of pliable material with extended upper and lower edges, which are each bisected by a slot of predetermined depth that extends at right angles to the respective edge. The hexagonal sheet contains four fold lines in the form of a laterally extended rectangle, wherein the shorter side fold lines, in conjunction with adjoining side faces of the hexagon, define triangular flap portions of the previously described cover pockets.

The longer side fold lines, in conjunction with the respective upper and lower adjoining sections of the hexagon, define upper and lower tetrahedron shaped flap portions which, when folded, abut the triangular side flap portions to which they are joined together. This attachment positions the horizontal edges of the sheet, in mutually adjoined relation, thus providing two reciprocally aligned access apertures, which allow the book to be inserted into the protective cover. The bisecting slots do not intersect the fold lines. Rather, the vertices of the slots are positioned away from the respective fold lines by a predetermined small amount, thereby creating two corresponding ridges of extra fabric, which mutually engage the ends of the spine of a book in a stabilizing relation therewith.

The present invention further provides a method for manufacturing a book cover from a pliable sheet of stretchable fabric having formed thereon an elastomeric layer of polyurethane resin. The method includes the steps of: cutting a substantially symmetrical hexagon that is laterally elongated from a sheet of polyurethane-coated elastic material; cutting a slot in each laterally elongated side in a substantially bisected relation therewith, wherein the slots extend at right angles to the respective elongated sides, and extend a predetermined distance into the hexagon; creating lateral extending fold lines and end fold lines orthogonal thereto, to form a rectangle having the corners thereof coincident with the four shorter sides of the hexagon; folding inward the flap portions of the hexagon, which are located about the periphery of the rectangle, to bring edge portions of the triangular and tetrahedron shaped flaps into a mutually adjoining relation; and sewing the adjoining edge portions together, thus forming pockets to receive and conceal the exposed covers of a book in protected relation therewith.

In the foregoing method, the bisecting slots may be cut to extend adjacent to, but not to intersect, the laterally extending fold lines. The subsequent folding of the upper and lower portions of the hexagon about the laterally extending fold lines creates a pair of central fabric ridges. The ridges engage the ends of the spine of a book in a stabilizing relation therewith when inserted within the protective cover.

The present invention may be cut from a polyurethane-coated stretchable polyester material, or from other polymerically-coated fabric materials composed of elastic threads, such as spandex. The substrate may be made impermeable by filling the interstices of the fabric with polyurethane resin. Conversely, the substrate may be made breathable, by means of forming a microporous layer within the polyurethane resinous layer to facilitate air-permeability while imparting water-resistant properties to the book cover. The four corners of the book cover, which are defined by the inward folding of the flap portions of the hexagon, may alternatively have relief notches to facilitate the lay-flat characteristics of the material for sewing. Additionally, the horizontal joints of the upper and lower tetrahedron flaps each comprise a row of stitching, which includes lock-stitching, that is applied at the innermost end, to withstand the stresses applied when the cover is stretched during the insertion of a book within the cover.

BEST MODE FOR CARRYING OUT THE INVENTION

Figure 1:
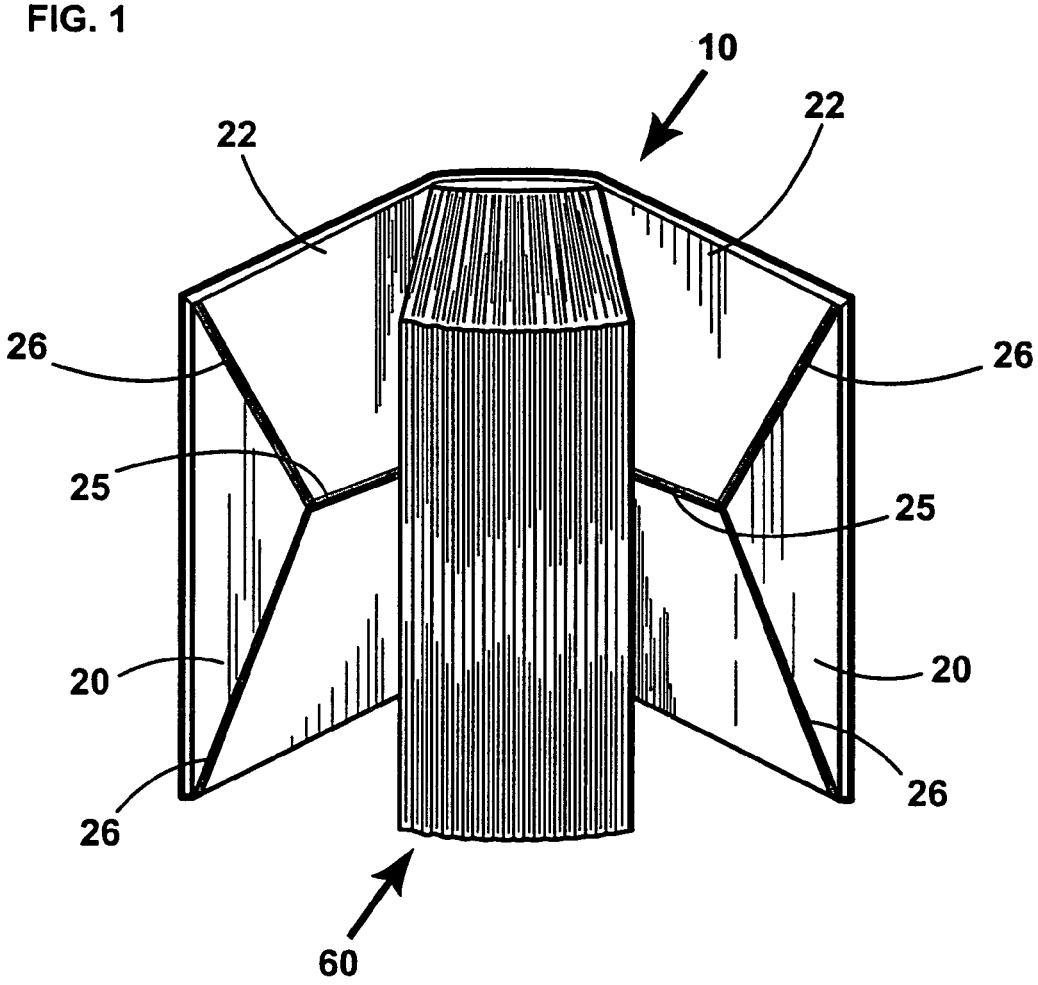
FIG. 1 is a front perspective view showing a book standing on its bottom edge, with the paperboard covers of the book concealed within a stretchable elastomeric-coated fabric book cover.
Figure 2:
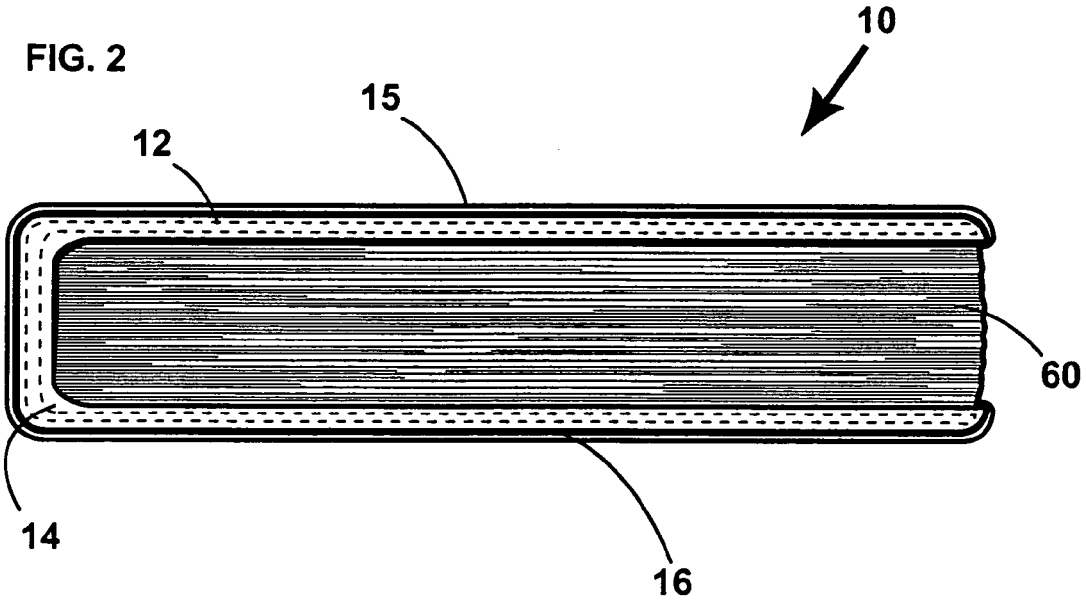
FIG. 2 is a bottom edge view of the book illustrated in FIG. 1.

Referring to FIGS. 1 and 2, a book 60 is shown, the paperboard covers 12 of which are contained within and concealed by a book cover 10 constructed in accordance with the present invention. The book cover 10 has a "spine locking" feature 14 that securely engages the top (not shown) and bottom spine portions of the book 60. The cover 10 is coated with an elastomeric polyurethane resin 15 which fills the interstices of the stretchable fabric 16, thus creating an impermeable waterproof barrier. According to the preferred embodiment, the transparent characteristic of the polyurethane resin 15 allows the aesthetic attributes of the stretchable fabric 16 to be visible, although an opaque resin may also be used.

Figure 3:
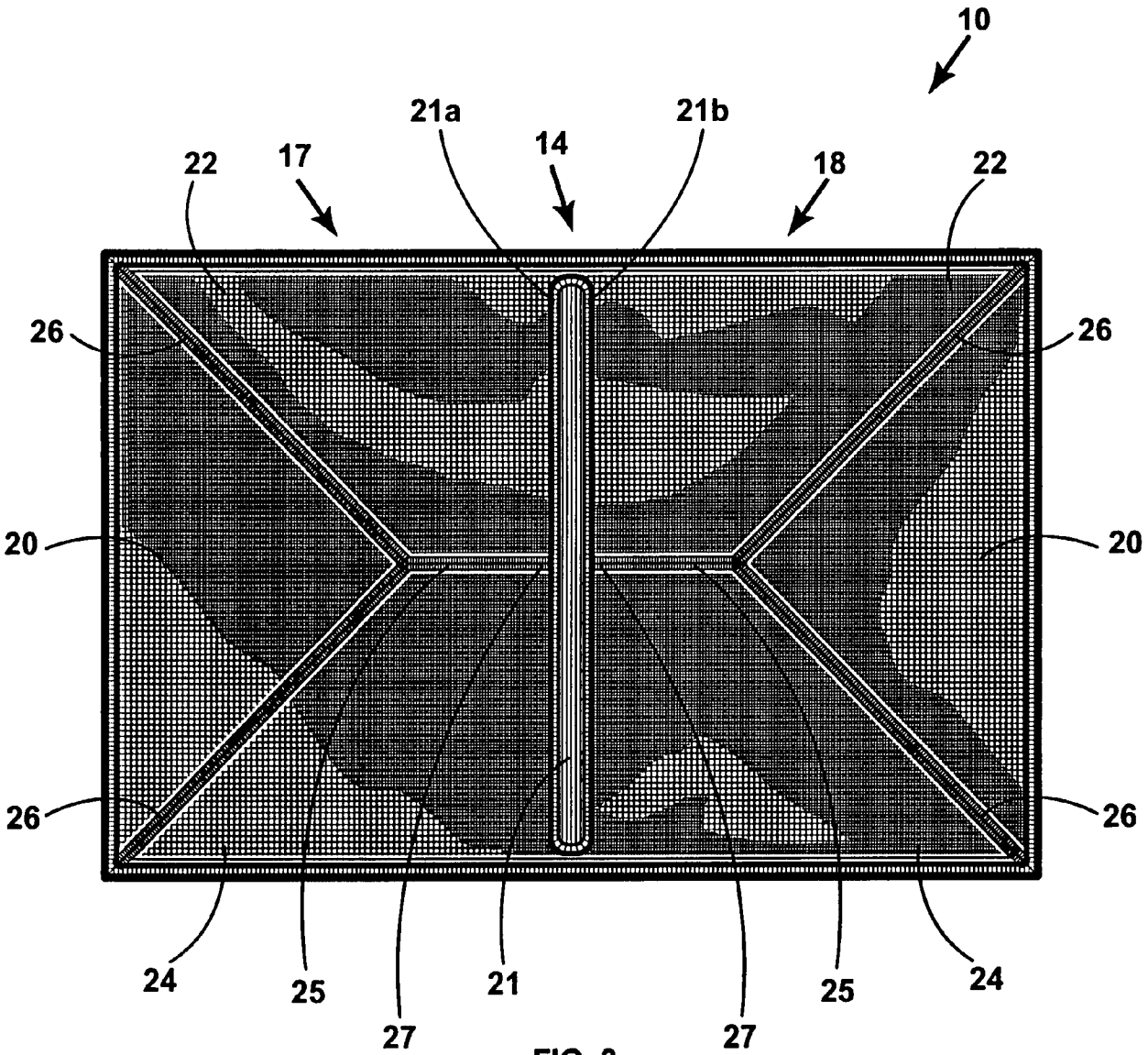
FIG. 3 is an interior plan view of a book cover in an open position according to an embodiment of the present invention.

The cover 10, as shown in FIG. 3, has a book cover access aperture 21 that is laterally bounded by a left front cover pocket portion 17 for receiving the book's front cover, and a right rear cover pocket portion 18 for receiving the book's back cover. The cover 10 consists of a number of panels that are in a mutually folded, edge secured relation.

As further illustrated in FIG. 3, lateral triangular panel portions 20, a top tetrahedron-shaped panel 22, and a bottom tetrahedron-shaped panel 24, converge to form the interior of the book cover 10. The book cover 10 is preferably fabricated inside-out to conceal the joining means of the cover. The top edge of panel 22 meets with the bottom edge of panel 24, and lines of stitching 25 secure the panels, thereby forming between them two reciprocally aligned access apertures 21*a* and 21*b*, which allow the book 60 to be inserted into the book cover 10. The innermost junctures of the top panel 22 and bottom panel 24 are reinforced by way of locking stitches 27.

The edges of the lateral triangular panel portions 20 are then secured with lines of stitching 26 to the unsecured edges of the newly formed pocket portions that were assembled from the panels 22 and 24 respectively. The sewn seams are made with interlock stitching, although other forms of stitching may be used. The completed book cover 10 is then turned right-side out through the access aperture 21. Alternative forms of connection such as taping, gluing, heat sealing, ultrasonic welding and/or radio frequency welding can also be utilized.

Figure 4:
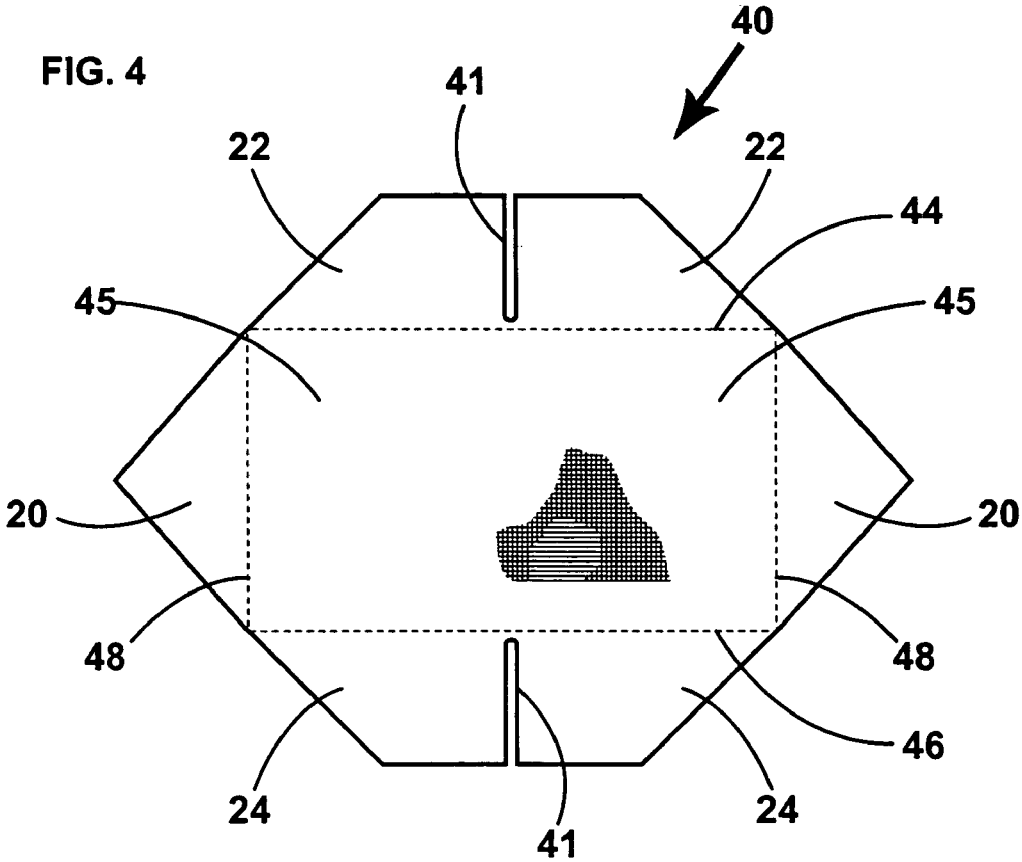
FIG. 4 is a plan view of the FIG. 3 embodiment in an unfolded, unstitched condition.
Figure 5:
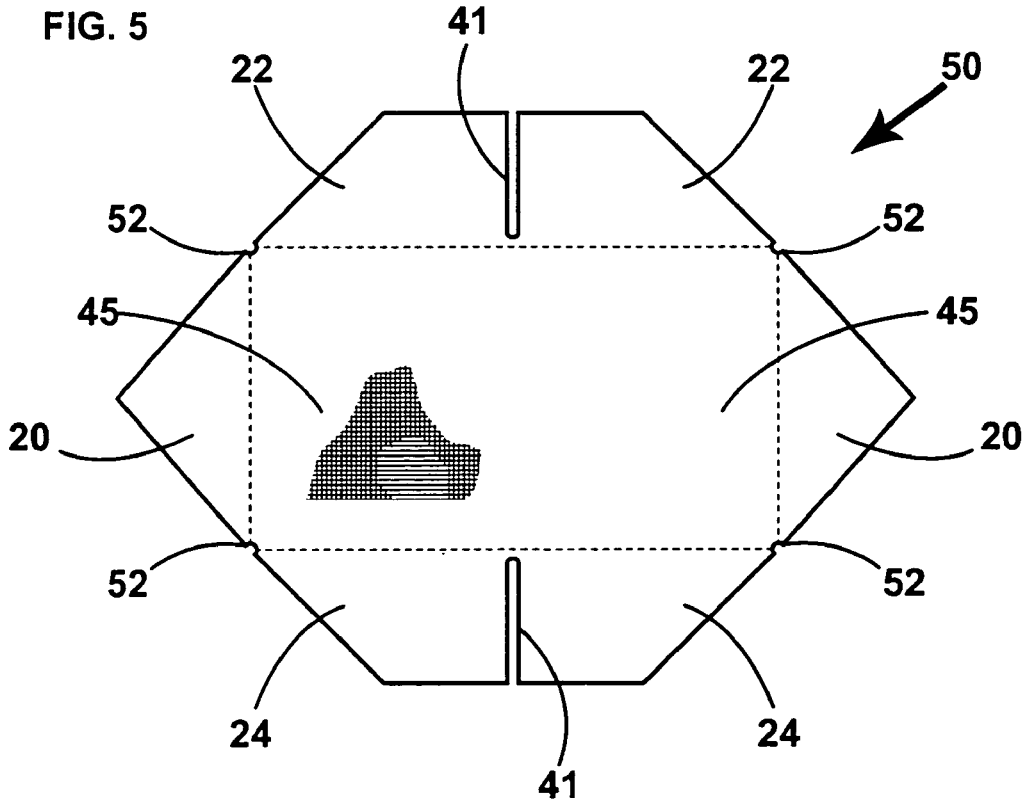
FIG. 5 is a plan view of an alternate embodiment of the FIG. 4 plan view in an unfolded, unstitched condition.

Referring to FIG. 4, the book cover blank 40 is an unequal hexagon shape, having a centered slot 41 of a predetermined length located at the top and bottom edges of the hexagon. The top fold line 44 and bottom fold line 46, together with a pair of lateral fold lines 48, form the bounds of the cover's outer panel 45, which includes an intermediate book spine area. The four fold lines 44, 46, and 48 define the two lateral triangular panels 20 and the top and bottom tetrahedron-shaped panels 22 and 24. Note that the inner portion of each slot 41 does not reach the respective fold lines 44 or 46, as shown in FIGS. 4 and 5. This results in top and bottom fold-over ridges of the cover 10 which mutually engage the top and bottom of the spine of a book 60 in a stabilizing relation.

Figure 6:
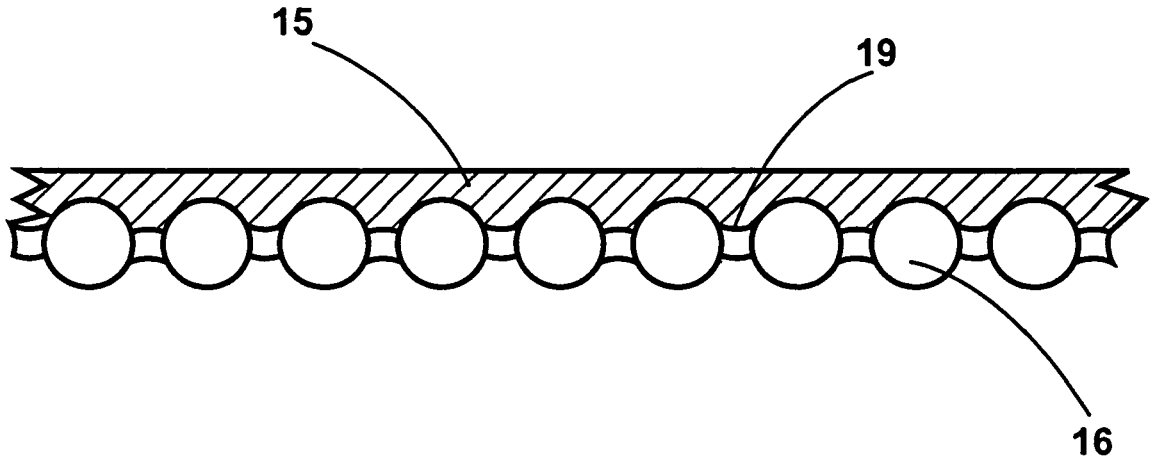
FIG. 6 is a cross-sectional view of the preferred embodiment of the present invention wherein one side of the stretchable fabric is coated with a single layer of elastomeric polyurethane resin.
Figure 7:
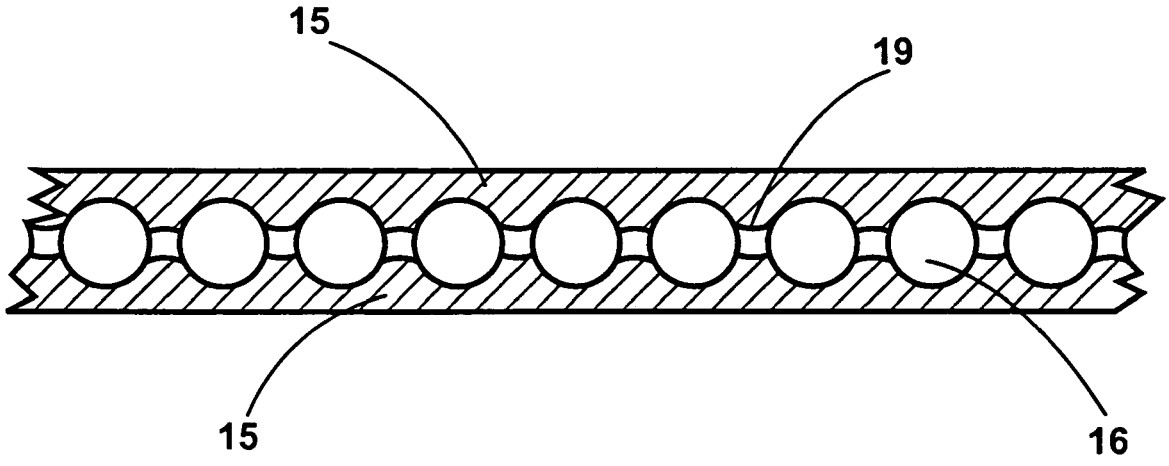
FIG. 7 is a cross-sectional view of an alternate embodiment of the present invention wherein two sides of the stretchable fabric are each coated with a single layer of elastomeric polyurethane resin.

As illustrated in FIG. 5, an alternate cover blank 50 may be utilized with relief notches 52 to facilitate the lay-flat characteristics of the converging panels 20, 22, and 24 before they are joined together. In addition, as seen in cross-sectional drawings of FIGS. 6 and 7, the cover blanks may be fabricated from a stretchable fabric 16 that is coated with a single or, alternatively, with a dual layer of elastomeric polyurethane resin 15. In either case, the interstices 19 of the stretchable fabric 16 are preferably filed with polyurethane resin to make the subject cover impermeable to moisture or grime.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

The invention claimed is:

1. A stretchable fabric book cover having a front cover pocket and a back cover pocket comprising a book cover blank including a hexagon shape having a first centered slot that extends from the top edge of the hexagon and a second centered slot that extends from the bottom edge of the hexagon, said book cover blank further having a top fold line, a bottom fold line and a pair of lateral fold lines, wherein the top, bottom, and pair of fold lines form boundaries of an outer panel of said book cover, wherein said outer panel the includes an intermediate book spine area, wherein the top, bottom, and pair of lateral fold lines define a pair of lateral triangular panels, a first top panel having at least four sides, a second top panel having at least four sides, a first bottom panel having at least four sides, and a second bottom panel having at least four sides, wherein each panel has respective edges, and wherein a bottom edge of said first top panel is joined by a joining means to a top edge of said first bottom panel and wherein a bottom edge of said second top panel is joined by said joining means to a top edge of said second bottom panel to thus form an access slot through which said front cover pocket and said back cover pocket can be accessed.

2. The book cover as specified in claim 1 wherein said book cover is fabricated from a stretchable fabric having a multiplicity of interstices, wherein said cover is coated with either a single or a dual layer of an elastomeric polyurethane resin that fills the interstices to make said book cover impermeable to moisture and grime.

3. The book cover as specified in claim 2 wherein the elastomeric polyurethane resin is transparent to allow aesthetic attributes printed on said book cover to be visible.

4. The book cover as specified in claim 1 wherein the inner edge of said slots terminate above and below the respective top and bottom fold lines.

5. The book cover as specified in claim 1 wherein said means for joining the respective edges of each said panel is selected from the group consisting of stitching, taping, gluing, heat sealing, ultrasonic welding and radio frequency welding.

6. The book cover as specified in claim 1 further comprising a relief notch located proximate to at least one corner of said book cover, wherein the relief notch facilitates making said panels lay flat before the panels are joined together.

* * * * *